US012311224B2

(12) United States Patent
Guerrero Padrón

(10) Patent No.: US 12,311,224 B2
(45) Date of Patent: May 27, 2025

(54) MUSCLE-BUILDING APPARATUS

(71) Applicant: IDA COVERTRUCK, S.L., Madrid (ES)

(72) Inventor: Juan José Guerrero Padrón, Madrid (ES)

(73) Assignee: IDA COVERTRUCK, S.L., Madrid (ES)

( * ) Notice: Subject to any disclaimer, the term of this patent is extended or adjusted under 35 U.S.C. 154(b) by 165 days.

(21) Appl. No.: 18/016,033

(22) PCT Filed: Jul. 27, 2020

(86) PCT No.: PCT/ES2020/070484
§ 371 (c)(1),
(2) Date: Jan. 13, 2023

(87) PCT Pub. No.: WO2022/023585
PCT Pub. Date: Feb. 3, 2022

(65) Prior Publication Data
US 2023/0271055 A1 Aug. 31, 2023

(51) Int. Cl.
*A63B 22/02* (2006.01)
*A63B 21/06* (2006.01)
*A63B 23/04* (2006.01)

(52) U.S. Cl.
CPC ..... *A63B 22/02* (2013.01); *A63B 21/0601* (2013.01); *A63B 22/0235* (2013.01); *A63B 23/047* (2013.01); *A63B 22/0242* (2013.01)

(58) Field of Classification Search
CPC . A63B 21/0601; A63B 22/02; A63B 22/0235; A63B 22/0242; A63B 22/0285; A63B 22/0257; A63B 23/047; A63B 2022/0271; A63B 2022/51; A63B 2024/0093; A63B 2225/09
See application file for complete search history.

(56) References Cited

U.S. PATENT DOCUMENTS

| | | | | |
|---|---|---|---|---|
| 6,676,569 | B1 | 1/2004 | Radow | |
| 7,381,161 | B2 * | 6/2008 | Ellis | A63B 22/0235 482/54 |
| 9,833,657 | B2 * | 12/2017 | Wagner | A63B 22/02 |
| 10,493,309 | B2 * | 12/2019 | Jue | A63B 21/00069 |
| 2007/0123396 | A1 | 5/2007 | Ellis | |
| 2011/0281691 | A1 * | 11/2011 | Ellis | A63B 23/047 482/54 |
| 2014/0274578 | A1 * | 9/2014 | Kennedy | A63B 21/225 482/54 |
| 2016/0339294 | A1 | 11/2016 | Blach | |
| 2020/0330818 | A1 * | 10/2020 | Thomas | A63B 21/062 |

* cited by examiner

*Primary Examiner* — Megan Anderson
(74) *Attorney, Agent, or Firm* — DUANE MORRIS LLP; Gregory M. Lefkowitz; Joaquin Hernandez

(57) ABSTRACT

A muscle-building apparatus for building the muscles of a user performing a physical exercise, comprising a frame on which are assembled a treadmill which is displaceable in a longitudinal direction and in opposite senses, a force generator that supplies an adjustable pushing or dragging force, and a swivelling support mechanically coupled to the force generator for the user to perform a pushing or dragging exercise on the swivelling support.

12 Claims, 4 Drawing Sheets

MUSCLE-BUILDING APPARATUS

CROSS-REFERENCE TO RELATED APPLICATIONS

This application is a § 371 national stage entry of International Application No. PCT/ES2020/070484 filed Jul. 27, 2020, the entire contents of which are incorporated herein by reference.

The present invention relates to a muscle-building apparatus for exerting the same force that would be exerted on a heavy object when pushed or dragged, for training and physical conditioning of the user of this apparatus.

STATE OF THE ART

It is known that the act of pushing or dragging heavy objects, such as a motor vehicle, promotes muscle growth very effectively and provides a muscle activity that is almost integral, so that this exercise is more complete and convenient than that carried out using other gymnastic devices that exercise partial areas of the body with regard to training for many athletic activities, such as football, rugby, athletics, basketball, etc.

Currently, to develop the specific training for these athletic activities, which require muscle power for starting, techniques are used that pursue building muscle in the lower body and abdominal muscles, consisting of dragging, using harnesses, sleds with heavy objects over large distances, as well as the use of small parachutes also using a harness, which exert a resistance when the user runs in the direction opposite to the wind.

In other activities, such as rugby, judo and other martial arts, in which pushing power is necessary, which requires a significant development of shoulder, back and leg muscles, techniques based on pushing sleds with added weights and frontal impact against padded shields are used.

In both cases, dragging or pushing, the user never knows the force they exert; in addition, a large space is needed to cover the distances. Ignorance of the force is due to the fact that in the case of dragging or pushing a sled with a load, the value of the force corresponds to that of the friction of the ground with the sliding element of the sled itself. The actual value of this force is $Fr=\mu \cdot N$, where $\mu$ is a coefficient, whose value is in the range 0 to 1, and depends on the materials in contact between the sliding element and the ground, N is the weight of the sled with its load. The value of $\mu$ is very difficult to determine, and can even experience important variations along the course of an exercise, as the properties of the ground change.

In the case of the use of a parachute, the ignorance of the resistive force that is exerted on the user is more evident, since its value depends on the square of the relative speed between the user and the wind current.

Consequently, the techniques described for training are not fitted to carrying out muscle building methods and programs, since the value of the resistive forces is unknown and their repetitiveness is uncontrollable.

Currently, muscle building machines present in any gym provide partial muscle enhancements, but do not involve the trunk and upper and lower limb muscles at the same time. These machines do allow to establish training methods, since the forces that will be applied during the exercises are known as they are based on moving masses, directly or indirectly, using mechanisms. Despite this, their use is not fully satisfactory for training aimed at the sports activities mentioned above, since the muscle action is local, and not generalized.

The apparatus object of this patent exerts a resistive action on the user that forces him or her to carry out a drag or pushing exercise on a bar, with predetermined value and direction, while at the same time moving a distance on a treadmill. The combined action of force and displacement requires using the muscles globally, as if dragging or pushing a sled loaded with masses, but without moving on the ground.

The device allows the selection and control of the exercise force, as well as the speed and operating time of the treadmill. By controlling all these magnitudes, the apparatus allows the development of training methods, which are performed on the machine, without displacement in open or closed terrain, unlike the techniques currently used based on sleds and parachutes.

SUMMARY

The present invention aims to resolve one or more of the drawbacks outlined above by means of a muscle-building apparatus as is defined in the claims.

The present invention aims to exercise almost all the muscles of the body without performing displacements using the muscle-building apparatus.

The muscle-building apparatus, in addition to facilitating the integral and harmonious building of most of the muscles of the user, maintains the natural orientation of the body while performing the simple operation of pushing or dragging, overcoming a force that can be prefixed up to a maximum value, such as the pushing or dragging of a motor vehicle.

Therefore, the muscle-building apparatus provides the realization of a physical exercise that simulates the pushing of an object of variable weight, from very light to very heavy, with very small dimensions so that very little space is required, facilitating its coexistence with other exercise apparatuses in confined spaces.

The muscle-building apparatus, in addition to serving as a training machine in athletic environments, can be used for medical tests.

The muscle-building apparatus comprises a treadmill that can perform its movement in two opposite directions, as required, a force generator that also acts in two opposite directions, clockwise and counter-clockwise, providing for each direction an adjustable force and, finally, a swivelling support on which the hands of the user rest to perform the exercise. The three elements or components are integrated together in a single frame.

Because the force generator can produce the force in one direction or the other, in combination with the direction of travel of the treadmill it can allow the user to perform the pushing and dragging or pulling exercises.

These exercises will strengthen agonist and antagonist muscles, through opposite movements and efforts such as pushing and dragging or pulling. The main agonist and antagonist muscles are the pairs: biceps-triceps, hamstrings-quadriceps, abdominal-lumbar.

If the pushing effort of a user is less than the force generated, the bar that pushes the user, supported by the swivelling support, moves down a few degrees towards the user. Otherwise, the bar tilts in the user's thrust direction some degrees.

In the case of dragging, this is reversed. The force generated tries to tilt the bar in the opposite direction to the user. The user must keep it in a substantially upright position.

The system makes it possible to exercise agonist and antagonist muscle through the action of walking on the treadmill, which the user performs during the execution of the exercise. This applies to both the pushing and the dragging exercise.

The muscle-building apparatus reproduces an effect similar to that of a wheel operated by an equine, for example. The animal operating a waterwheel has to overcome a horizontal force during its path. The path is circular around the waterwheel.

The wheel has a swivel arm of several meters, at the end of which the equine is attached. The length of this arm coincides with the radius of the circles that the animal follows when doing the work.

The treadmill of the muscle-building apparatus eliminates the need for the user to have to move along a trajectory, so that the user moves on the same site without having to make circles around the muscle-building apparatus, exercising, in addition, both arms equally.

BRIEF DESCRIPTION OF THE FIGURES

A more detailed explanation of the invention in accordance with the embodiments thereof is given in the description below, based on the attached figures in which.

DETAILED DESCRIPTION

Figure 1:
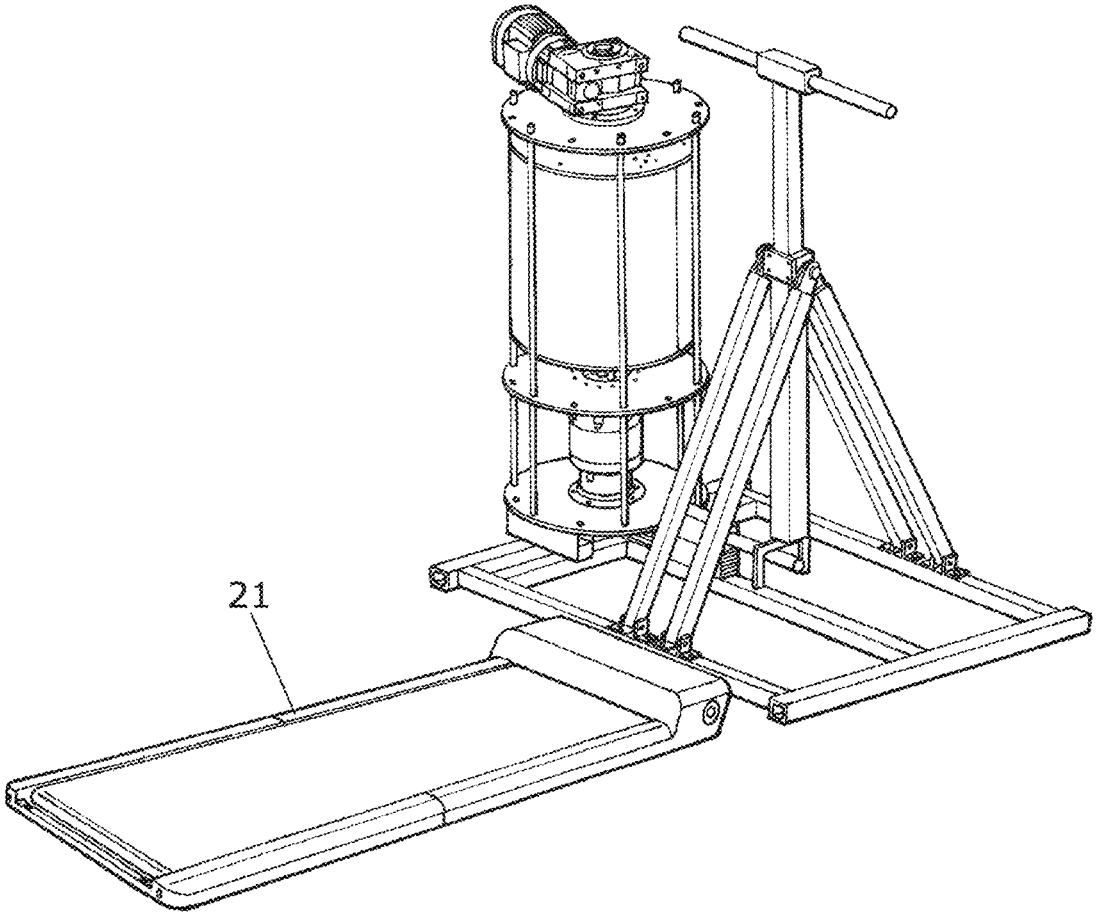
FIG. 1 shows a perspective view of a muscle-building apparatus comprising a force generator, a swivelling support and a treadmill mounted on a frame.
Figure 2:
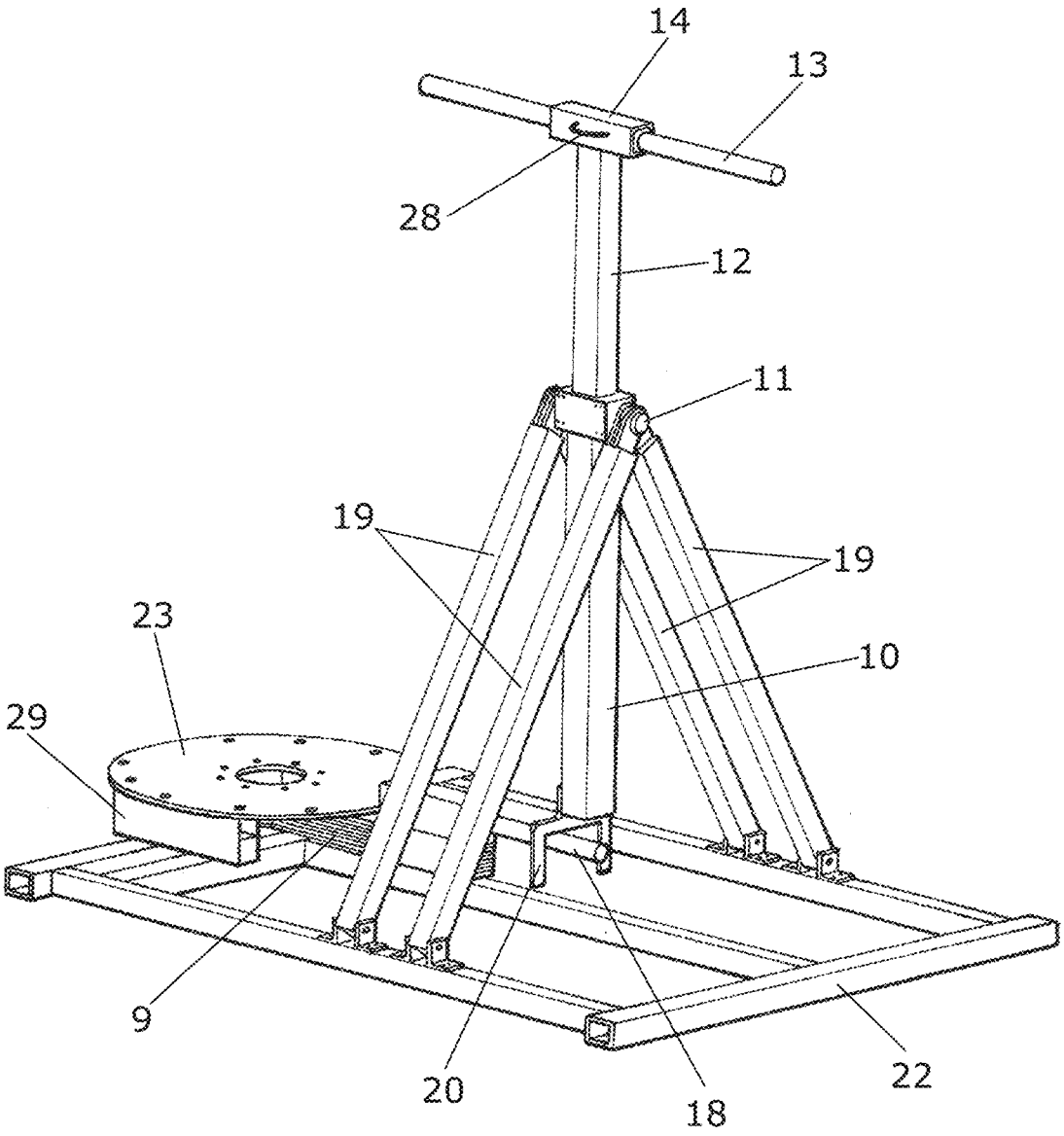
FIG. 2 shows a perspective view of the swivelling support on the frame.
Figure 3:
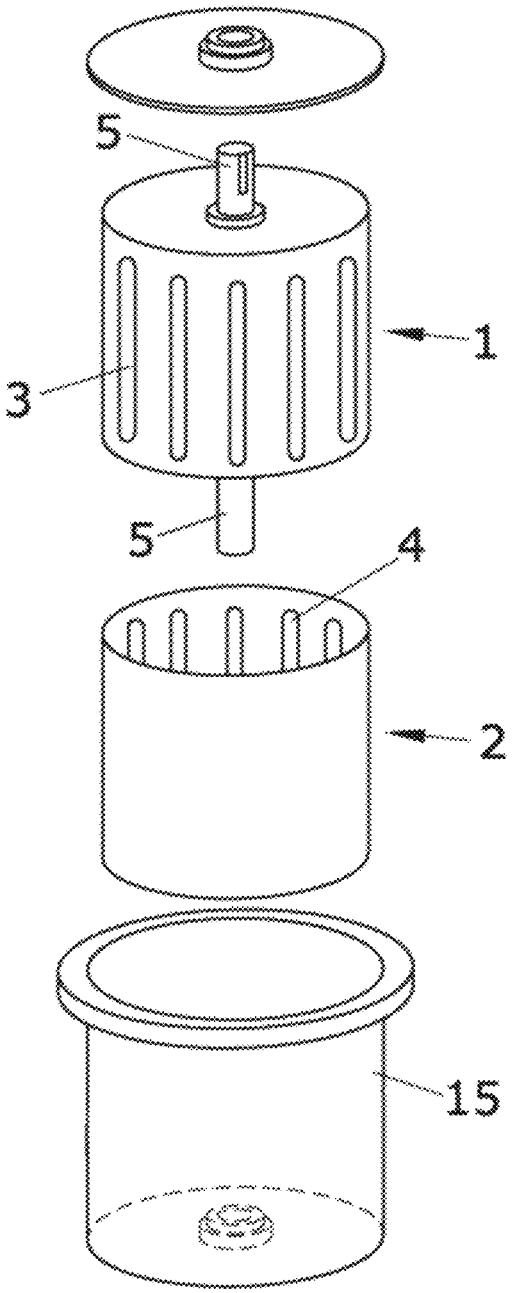
FIG. 3 shows an exploded perspective view of the force generator providing a torque.
Figure 4:
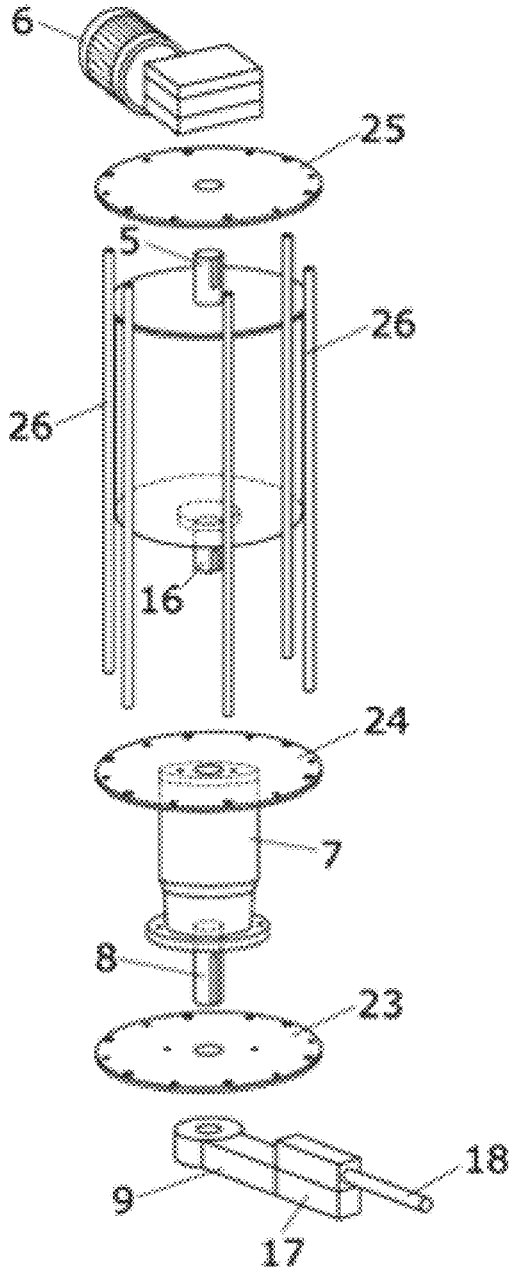
FIG. 4 shows a perspective view of an assembly of the force generator.

Referring now to FIGS. 1, 2, 3 and 4, where an embodiment of a muscle-building apparatus 31 is shown which relates to a mechanical device suitable for being employed by a user to develop, by means of its use, a generalized muscle building in their body in a single physical exercise.

The muscle-building apparatus 31 comprises a treadmill 21 which can move in a longitudinal direction and in opposite directions, a force generator which can act in two opposite directions of operation, pushing or dragging, and which provides for each direction an adjustable force, and a swivelling support on which the pushing or dragging is carried out.

The force generator comprises an inner annular cylinder 1 and an outer concentric cylinder 2, wherein the opposite faces of the inner annular cylinder 1 or rotor and of the outer concentric cylinder 2 or stator comprise a plurality of first vertical ribs 3 and a plurality of second vertical ribs 4 uniformly distributed on the respective inner and outer surfaces of the annular cylinder 1 and of the concentric cylinder 2.

The first and second vertical ribs 3, 4 run along the casing of each annular cylinder 1 and concentric cylinder 2 from the corresponding upper edge to the lower edge opposite the upper edge of the cylinder 1, 2.

The number of first vertical ribs 3 can be the same or different from the number of second vertical ribs 4, so that, during rotation of the annular cylinder 3 inside the concentric cylinder 2 there is no physical contact between the first and second ribs 3, 4.

The inner annular cylinder 1 is concentric to the hollow concentric cylinder 2, so that both cylinders 1, 2 are arranged in the form of a rotor-stator arrangement.

The first and second vertical ribs 3, 4 of the annular cylinder 1 and concentric cylinder 2 do not collide or touch each other because the corresponding outer surfaces of the first and second vertical ribs 3, 4 are separated by a predetermined threshold distance.

The gap or threshold distance allows a relative rotary movement of the inner annular cylinder 1 or rotor with respect to the outer concentric cylinder 2 or stator. Both the annular cylinder 1 and the concentric cylinder 2 are immersed in a viscous fluid that is contained in a sealed container 15. Therefore, the container 15 is adapted to house the annular cylinder 1 and the concentric cylinder 2 immersed in the viscous fluid. The viscous fluid in liquid phase occupies all the free spaces existing within the closed container 15 between the concentric cylinder 2 and the annular cylinder 1.

The force generator further comprises a concentric shaft 5 mechanically actuated by means of a geared motor assembly 6 which, in turn, is mechanically coupled to the annular cylinder 1.

If the geared motor assembly 6 applies a rotational movement to the concentric shaft 5, in its rotational movement the shaft 5 drives the annular cylinder 1, which transmits a drag force to the concentric cylinder 2.

When the annular cylinder 1 rotates inside the concentric cylinder 2, the fluid existing between the opposite faces of the two cylinders 1, 2 causes a turbulence that generates a viscous dissipation of the kinetic energy coming from the concentric axis 5. The viscosity of the fluid combined with the resistance to the passage of the fluid due to the existence of the first and second ribs 3, 4 arranged on the opposite faces of the annular cylinder 1 and the concentric cylinder 2, causes a resistant force to appear that drives the cylinder 2.

An overall heating occurs in the fluid due to convection currents within itself from the zone of turbulence in the interface between both cylinders 1, 2.

The liquid phase fluid may be water, oil, mineral oil, vegetable oil and liquid-phase chemical elements, or the like.

The viscous fluid performs a hydraulic clutch function when both cylinders 1, 2 are subjected to a relative rotational movement.

The concentric cylinder 2 is arranged inside the container 15 and, in addition, is mechanically fixed to the closed container 15, so that, if the concentric cylinder 2 is dragged by the relative rotation of the annular cylinder 1, the container 15 rotates jointly with the concentric cylinder 2.

In this situation, the container 15 could be retained by applying a retention torque equal to the drag torque exerted by the fluid by the action of the rotation of the annular cylinder 1.

The container 15 comprises an integral shaft 16 which is arranged at the bottom base of the container 15 and, in turn, the integral shaft 16 is co-aligned with the concentric shaft 5, so that the integral shaft 16 transmits the torque it receives from the container 15 to the input of an epicyclic gear 7 connected to the integral shaft 16.

The epicyclic gear 7 exerts at its output shaft 8 a torque equal to the received torque multiplied by its gearing coefficient, so that the torque it delivers is greater than the one it receives.

The lever 9 is connected to the output shaft 8, in an orthogonal position to said shaft 8. The lever 9 is coupled at its other end to an extender comprising at least two tube bushings 17 and an extender bar 18, all mechanically coupled, to tilt a vertical tube 10 disposed at an end opposite the arrangement of the tube bushings 17. The extender bar 18 rotates horizontally pushing an inverted U-shaped fork 20 located on the opposite end of the extender bar 18. The torque at the output of the reducer 7 is thus converted into an increased force on which the user must act.

The fork 20 is attached to the lower end of a vertical tube 10 which is arranged to tilt by being suspended by an upper end, which is mechanically coupled to a horizontal axis hinge 11, which is supported by a set of diagonally arranged support tubes 19.

Additionally, at the upper end of the vertical tube 10, the tube 12 that is concentric thereto protrudes; that is, the vertical tube 10 and the upper tube 12 are mounted telescopically, so that the length of the tube 12 that protrudes from the tube 10 is adjustable to adjust to the most convenient height that the user demands. The adjustment is made by a pin that locks the two tubes in a matching hole.

The upper tube 12 is mechanically attached by its upper end to a horizontal gripping bar 13 by means of a crossbar 14. The crossbar 14 has incorporated on one of its faces a ring, lug or eyelet 28, to allow the pulling exercise, as explained below.

The adjustment between the tubes 10 and 12 is not rigid, but instead has a small play that allows users pushing on the grip bar 13 to adjust the force of their arms to keep it in a plane perpendicular to itself, without turning with respect to the middle crossbar of the frame 22. Thus, an exercise is achieved with a symmetrical action by both arms.

In summary, the swivelling support is composed of the vertical tube 10, hinge 11, upper tube 12, crossbar 14 and grip bar 13 with a T shape.

Users can perform the exercise by pushing on the grip bar 13 with the palms of their hands, or by pulling the crosshead 14 by means of a cord or chain attached to the earring or eyelet 28 of the crosshead 14 by means of a carabiner. In this case the user is attached to the cord or chain by means of a harness.

The pushing exercise consists of pressing with the hands on the grip bar 13 to keep the T-shaped swivelling support in a substantially vertical position.

In addition, the user must move on the treadmill 21 that moves in the opposite direction to the frame 22, while maintaining the pushing force applied on the grip bar 13 of the T-shaped swivelling assembly. The speed of the treadmill 21 is adjustable by means of an electronic control that acts on the frequency variator that controls it.

The geared motor assembly 6 is connected to another frequency variator to allow electronic control of the rotation speed of the concentric shaft 5. At low speeds, the drag torques exerted by the annular cylinder 1 on the concentric cylinder 2 are low; on the contrary, at higher speeds, the drag torques are greater. The desired operating mode of the muscle-building apparatus is programmed through the frequency variator.

In the pulling exercise, the user is provided with a harness and they are positioned on the treadmill, with their back to the swivelling support. The harness is attached at its back to a belt or chain, which at its other end is attached to the ring 28. The user walks on the treadmill 21 in the direction opposite to the frame 22.

The force generator, by means of the geared motor 6 which rotates in the opposite direction to the case of the previous exercise, pushing, applies a force to the lever 10 in such a way that it tilts the crossbar 14 in the opposite direction to the user's position. In turn, the treadmill 21 moves, governed by its frequency variator controlled by the control electronics, towards the frame 22.

The exercise that the user performs in this case is walking in the opposite direction to the frame 22, overcoming the force exerted on the crossbar 14 by means of the harness, trying to put it in an approximately upright position.

The muscle-building apparatus comprises a frame 22 on which the force generator and the swivelling support are assembled. The force generator is anchored by means of the plates 23, 24, 25 and a set of rods 26 that join them together. The horizontal plate 23 is attached to the frame 22 by means of lower bushings 29.

The swivelling support is anchored by means of the lower ends of the set of support tubes 19 to the frame 22.

Attached to one side of the frame 22 is the treadmill 21, which has its own geared motor and integrated frequency variator, to be able to select a speed and direction of travel.

The two frequency variators that regulate the force of the force generator and the speed of the treadmill 21 form part of a control electronics that allows the user to choose the force and its direction, the speed or distance and direction of travel to be performed on the belt and the duration of the exercise time.

LIST OF NUMERICAL REFERENCES

1 annular cylinder rotor
2 concentric cylinder stator
3 first ribs of the annular cylinder rotor
4 second ribs of the concentric cylinder stator
5 concentric shaft
6 geared motor unit
7 epicyclic gear
8 output terminal shaft
9 lever
10 vertical tube
11 hinge
12 upper tube
13 grip bar
14 crossbar
15 container
16 integral shaft
17 tube bushings
18 extension bar
19 support tubes
20 fork
21 treadmill
22 frame
23 support base plate
24 first junction plate
25 second junction plate
26 stiffening rods connecting the plates 23, 24, 25.
27 upper lid of the container
28 ring, lug or eyebolt for the pulling exercise.
29 lower bushings

The invention claimed is:

1. A muscle-building apparatus for building the muscles of a user performing a physical exercise, the muscle-building apparatus comprising a treadmill which is displaceable in a longitudinal direction and in opposite senses, a force generator that supplies an adjustable pushing or dragging force, and a swiveling support mechanically coupled to the force generator for the user to perform a pushing or dragging exercise on the swiveling support, wherein the force generator comprises an inner annular cylinder, an outer concentric cylinder, wherein the opposite faces of the inner annular cylinder and the outer concentric cylinder comprise a plurality of first vertical ribs and a plurality of second vertical ribs uniformly distributed on the respective inner and outer surfaces of the inner annular cylinder and the outer concentric cylinder.

2. The muscle-building apparatus according to claim 1, wherein the force generator further comprises a concentric shaft mechanically actuated by a geared motor assembly which is mechanically coupled to the inner annular cylinder.

3. The muscle-building apparatus according to claim 2, wherein the plurality of first and second vertical ribs extend along a casing of the inner annular cylinder and of the outer concentric cylinder from an upper edge to a lower edge opposite the upper edge of the respective one of the inner annular cylinder and the outer concentric cylinder.

4. The muscle-building apparatus according to claim 3, wherein the inner annular cylinder and the outer concentric cylinder are immersed within a viscous fluid, which is contained in a sealed container.

5. The muscle-building apparatus according to claim 4, wherein the sealed container is mechanically fixed to the outer concentric cylinder such that the outer concentric cylinder and the sealed container rotate jointly.

6. The muscle-building apparatus according to claim 5, wherein the sealed container comprises an integral shaft which transmits torque it receives from the sealed container to an input of an epicyclic gear.

7. The muscle-building apparatus according to claim 6, wherein the epicyclic gear comprises an output shaft that exerts a torque equal to the torque received from the integral shaft multiplied by its gearing coefficient.

8. The muscle-building apparatus according to claim 7, wherein the output shaft is configured to tilt a vertical tube of the swiveling support.

9. The muscle-building apparatus according to claim 8, wherein the swiveling support comprises the vertical tube, a hinge, an upper tube, a crosshead and a grip bar having a T-type shape.

10. The muscle-building apparatus according to claim 9, wherein the user is capable of performing physical exercise by applying a force on the grip bar while moving on the treadmill that moves in the direction opposite to a frame.

11. The muscle-building apparatus according to claim 10, wherein a speed of the treadmill is adjustable by an electronic control acting on a frequency variator.

12. The muscle-building apparatus according to claim 1, wherein the treadmill, the force generator and the swiveling support are mounted on a frame.

* * * * *